US006098406A

United States Patent [19]

Bolis et al.

[11] Patent Number: 6,098,406

[45] Date of Patent: Aug. 8, 2000

[54] PREMIX BURNER FOR OPERATING A COMBUSTION CHAMBER WITH A LIQUID AND/OR GASEOUS FUEL

[75] Inventors: Giacomo Bolis, Zurich; Hans Ulrich Frutschi, Riniken, both of Switzerland

[73] Assignee: Asea Brown Boveri AG, Baden, Switzerland

[21] Appl. No.: 08/992,473

[22] Filed: Dec. 17, 1997

[30] Foreign Application Priority Data

Dec. 21, 1996 [DE] Germany ..... 196 54 009

[51] Int. Cl.[7] ..... F23D 17/00

[52] U.S. Cl. ..... 60/737; 60/748; 431/8; 431/353

[58] Field of Search ..... 60/737, 748, 732, 60/733; 431/8, 173, 188, 353

[56] References Cited

U.S. PATENT DOCUMENTS

| | | | |
|---|---|---|---|
| 4,500,282 | 2/1985 | Eschenko et al. | 431/184 |
| 4,932,861 | 6/1990 | Keller | 431/8 |
| 5,147,200 | 9/1992 | Knopfel et al. | 431/11 |
| 5,433,596 | 7/1995 | Dobbeling et al. | 431/350 |
| 5,588,826 | 12/1996 | Doebbeling et al. | 431/183 |
| 5,674,066 | 10/1997 | Hausermann et al. | 431/173 |
| 5,699,667 | 12/1997 | Joos | 60/737 |

FOREIGN PATENT DOCUMENTS

| | | |
|---|---|---|
| 0321809B1 | 5/1991 | European Pat. Off. . |
| 0436113A1 | 7/1991 | European Pat. Off. . |
| 3136911C2 | 7/1985 | Germany . |
| 3600784C2 | 4/1990 | Germany . |

*Primary Examiner*—Ted Kim
*Attorney, Agent, or Firm*—Burns, Doane, Swecker & Mathis, L.L.P.

[57] ABSTRACT

A premix burner for a gas turbine engine having a pair of partial conical bodies stacked inside each other to form a conical interior chamber is disclosed. The conical bodies are offset laterally to form tangential air flow openings. The width of the openings is varied in a prescribed manner to induce rotational disorder.

8 Claims, 3 Drawing Sheets

FIG. 2
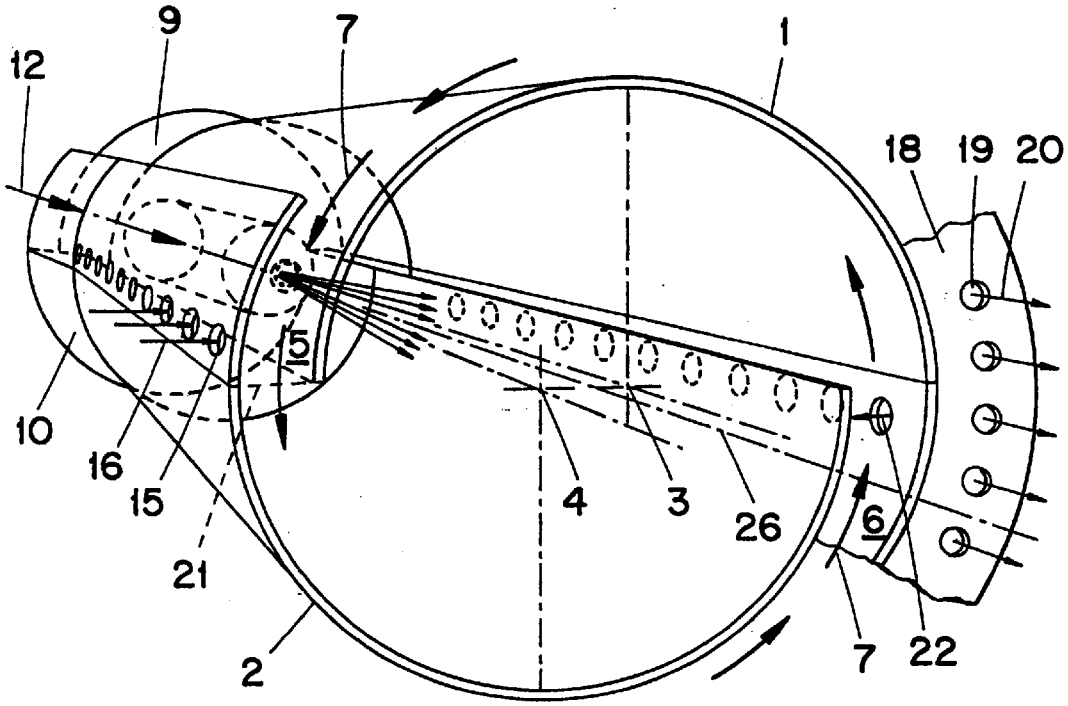
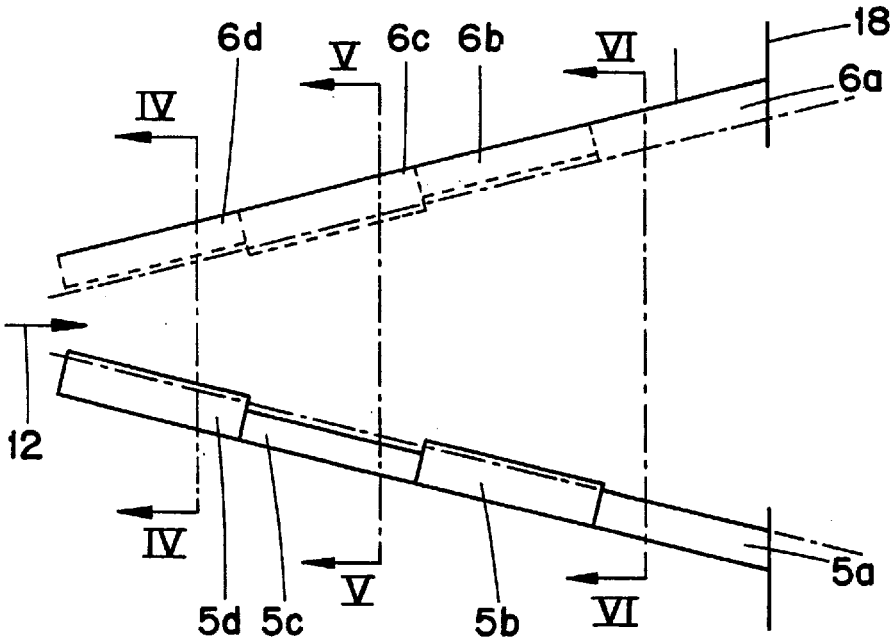
FIG. 3

PREMIX BURNER FOR OPERATING A COMBUSTION CHAMBER WITH A LIQUID AND/OR GASEOUS FUEL

FIELD OF THE INVENTION

This invention relates to a premix burner for a gas turbine.

BACKGROUND OF THE INVENTION

One known method for building a non-separating rotational body consists of providing a pipe mantle with tangential air inlet channels or air inlet slits. This creates a potential vortex which flows off axially. It was found, however, that vortex backflow zones in a potential vortex have poor stability properties. In order to create stable vortex backflow zones, the axial profile of the vortex stream created by the rotational body must have few rotations in the center, i.e. on the burner axis, and must have an excess axial velocity there. These considerations, i.e. to combine the advantages of a potential vortex and a rotational body that is perfect in terms of flow mechanics, have resulted in a burner according to EP-B1-0 321 809.

There is a risk with this burner, especially if operated with liquid fuel, that the flame can wander inside the burner, i.e. any time the axial speed in the center falls below a certain value. Then the flame can spread unhindered against the flow direction. The flame then wanders into the burner, usually creating overheating problems as a result. The generation of a rotational flow field has an important influence on creating a backflow zone, also called a backflow bubble, at the burner outlet. The generation of the rotational flow field requires that the stream be enclosed in an axially rotation-symmetrical space, which creates a "tube-shaped" zone especially in the center which is susceptible to a flame backflash in the counter-flow direction.

SUMMARY OF THE INVENTION

It is an object of this invention to overcome the problems identified above. The invention is based on the modification of a burner of the initially mentioned type with the objective of reinforcing the zone that forms on the burner axis against a flame backflash.

According to the invention this is achieved by interfering with the regular expansion of the "tube-shaped" zone within the burner. In its place, a rotation-like disorder is formed in the center of the burner in the axial direction in such a way that the flame is no longer able to propagate from the combustion chamber along the burner axis into the burner. The interference with the "tube-shaped" inner zone is created in the axial direction by specific inflow conditions for certain sections and in an irregular manner below each other. Only in the end zone of the burner, in the area of the backflow zone that subsequently forms there, a rotational symmetry is created again, so that the interdependence between rotational symmetry and the backflow zone becomes effective again. The flow rotational disorder is present upstream from this rotational-symmetrical section, preventing the flame from being able to flash back unhindered.

BRIEF DESCRIPTION OF THE DRAWINGS

A preferred embodiment of the invention is illustrated and described with reference to the drawings. All elements not required for the direct understanding of the invention have been left out. The flow direction of the media is shown with arrows. In the drawings:

FIG. 2 is a perspective schematic view of the premix burner according to FIG. 1;

FIG. 3 is a schematic view of the design of the flow-through openings of the air inlet channels;

DETAILED DESCRIPTION

Figure 1:
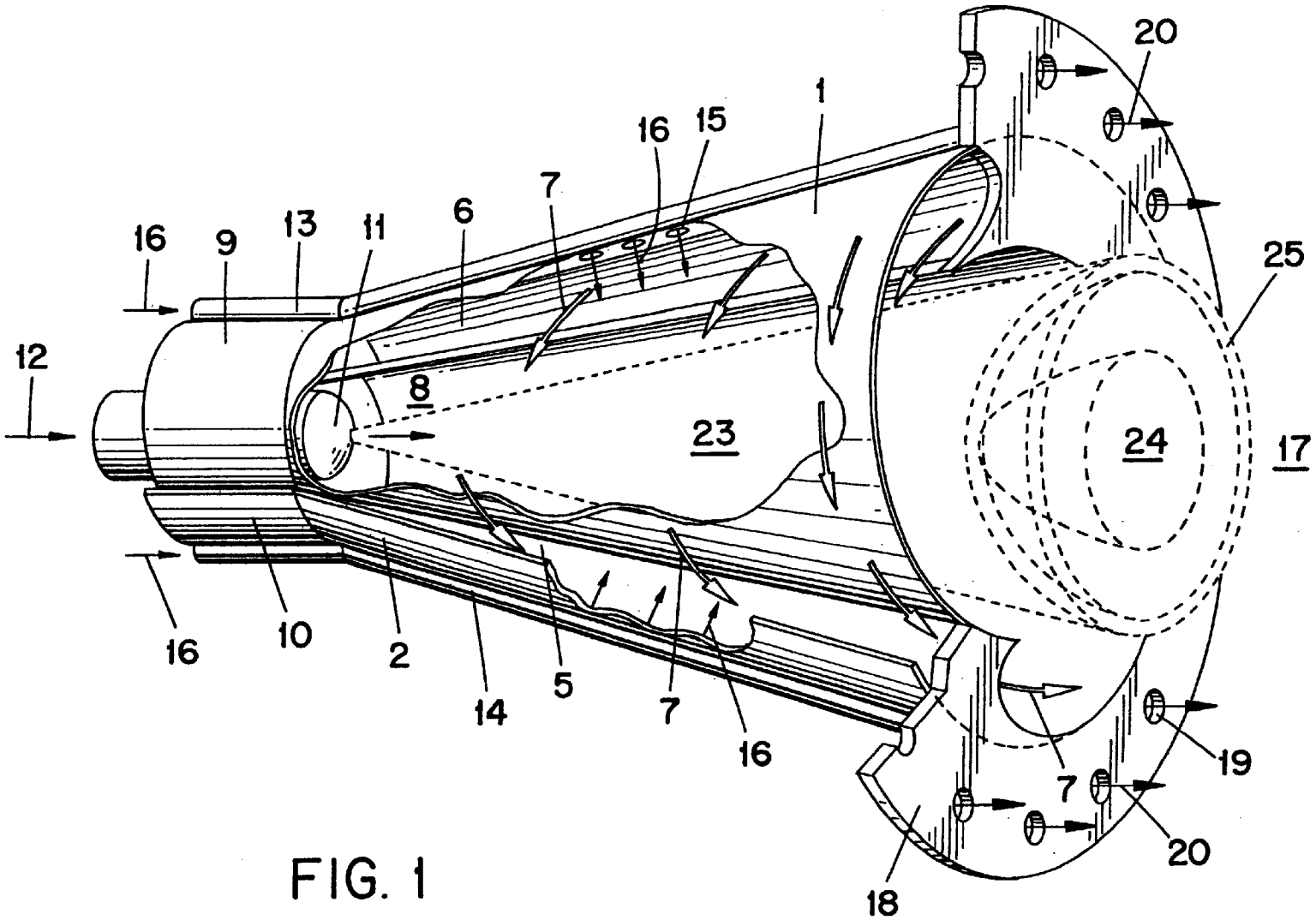
FIG. 1 is a perspective view of a premix burner, partially in section.

FIG. 1 shows a perspective view of a premix burner. In order to better understand the subject, it is advantageous to refer to FIG. 2 along with the explanation of FIG. 1. These two figures mainly have the purpose of outlining the type and function of such a burner. The other figures are then described in more detail with regard to the design of the flow-through openings of the tangential air inlet channels.

The premix burner according to FIG. 1 has two hollow, conical partial bodies 1, 2 which are stacked in an offset manner inside each other. The term "conical" here means not only the conical shape that is shown and characterized by a fixed opening angle, but it also includes other configurations of the partial body, e.g. a diffusor or diffusor-like form, as well as a confusor or confusor-like form. These forms are not shown specifically here, since they are commonly known to the expert. The offsetting of the respective center axis (3, 4) or longitudinal symmetry axis of the partial bodies 1, 2 in relation to each other (see FIGS. 2 and 4–6) makes room on both sides, in a mirror-symmetrical arrangement, for each tangential air inlet channel 5, 6, through which the combustion air 7 flows into the inside of the premix burner, i.e. into the conical cavity 8. The two conical partial bodies 1, 2 each have a cylindrical beginning part 9, 10 which also, analogous to the previously mentioned partial bodies 1, 2, extend offset to each other, so that the tangential air inlet channels 5, 6 are present over the entire length of the premix burner. In the area of the cylindrical beginning part, a nozzle 11 for the preferred atomization of a liquid fuel 12 is located in such a way that fuel is injected approximately into the smallest cross-section of the conical cavity 8 that is formed by the partial bodies 1, 2. The nozzle capacity and the mode of operation of this nozzle 11 depend on the pre-determined parameters of the respective premix burner. The fuel 12 injected through the nozzle 11 can be enriched, if required, with a recycled waste gas. It would then also be possible to achieve the complementary injection of an amount of water through the nozzle 11.

Naturally, the premix burner can be constructed completely conical, i.e. without cylindrical beginning parts 9, 10. The partial bodies 1, 2 also have one fuel line 13, 14 each, which are located along the tangential inlet channels 5, 6 and which are provided with inlet ports 15, through which preferably a gaseous fuel, as is illustrated by arrows 16, is injected into the combustion air 7 flowing by. Fuel is simultaneously injected through ports 22 on the opposite side of the burner (see FIG. 2). These fuel lines 13, 14 are placed preferably at the end of the tangential inflow, prior to the entrance of the conical cavity 8, in order to ensure an optimum air/fuel mixture.

On the combustion chamber side, the premix burner has a front plate 18 that functions as a support for partial bodies 1, 2 and which is provided with a number of bores 19 through which, if required, mixing or cooling air 20 is supplied to the front part of the combustion chamber 17 or its wall.

If liquid fuel 12 is supplied via the central nozzle 11 for the operation of the premix burner, this fuel is injected at an acute angle into the conical cavity 8 or into the combustion chamber 17. From the nozzle 11, therefore, a conical fuel profile 23 forms and is enclosed by the rotating combustion air 7 that flows in tangentially. The concentration of the injected fuel 12 is continuously reduced in the axial direction by the entering combustion air 7 to form an optimum mixture. If the premix burner is operated with a gaseous fuel 16, it may be supplied principally via the fuel nozzle 11. If the gaseous fuel is supplied via nozzle openings 15, an optimum fuel/air mixture is produced directly at the end of the air inlet channels 5, 6.

During the injection of the liquid fuel 12 through the nozzle 11, the optimum homogeneous fuel concentration is achieved over the cross-section at the end of the premix burner. If the combustion air 7 is additionally preheated or enriched with a recycled waste gas, this supports the evaporation of the liquid fuel 12 in a sustained manner inside the premix section induced by the length of the premix burner. The same considerations are also true if liquid fuels instead of gaseous ones are supplied via fuel lines 13, 14.

When designing the conical partial bodies 1, 2 with regard to the increase in the flow cross-section, as well as the width of the tangential air inlet channels 5, 6, actually narrow limits must be observed so that the desired flow field of the combustion air 7 can form at the output of the premix burner. The critical rotation value must also be present at the output of the premix burner. With respect to the flame front 25 acting there, a backflow zone 24 (vortex breakdown) forms that has a stabilizing effect, in the sense that the backflow zone 24 assumes the function of a bodiless flame holder.

The optimum fuel concentration over the entire cross-section is only achieved in the area of the vortex breakdown, i.e. in the area of backflow zone 24. It is only at this point that a stable flame front 25 is then created. The flame-stabilizing effect is a result of the rotational value in the flow direction that forms in the conical cavity 8 along the cone axis. A flash-back of the flames into the premix burner can thus only occur at the most extreme operating conditions, but this problem is overcome by the arrangement according to FIGS. 3–6.

In general, minimizing the flow-through opening of the tangential air inlet channels 6, 7 causes the backflow zone 24 to form from the end of the premix section. The construction of the premix burner is also very well suited for changing the flow-through opening of the tangential air inlet channels 5, 6 as required, so that a relatively large operating band width can be obtained without changing the construction length of the premix burner. Naturally, the partial bodies 1, 2 can also be moved relative to each other in another plane, so that even an overlapping, in relation to the air inlet plane in the conical cavity 8 (see FIG. 2, No. 21) of the same, can be realized in the area of the tangential air inlet channels 5, 6, as is shown in FIG. 2. With a counter-rotating movement it is also possible to stack the partial bodies 1, 2 in the manner of a spiral inside each other.

With a more homogeneous formation of a mixture of the injected fuels 11, 12 with the combustion air 7 that can be achieved in the premix burner, achieves lower flame temperatures and thus lower noxious emissions, in particular lower NOx values, are achieved. These lower temperatures reduce the thermal stress on the material at the burner front and, for example, eliminate the need for a special surface treatment.

Regarding the number of air inlet channels, the premix burner is not limited to the number shown. A higher number is, for example, indicated where the purpose is to construct the pre-mixer wider or to respectively influence the rotation value, and thus the formation of the backflow zone 24 that depends on it, through a greater number of air inlet channels. In this context we incorporate by reference EP-A2-0 704 657 for its disclosure of this feature.

Premix burners of the type described here also include those which are based on a cylindrical or quasi-cylindrical pipe for achieving a rotational flow. In this type of burner, the inflow of the combustion air into the pipe is also achieved via tangentially arranged air inlet channels, and also includes the type in which a conical body with a cross-section that decreases in the flow direction is arranged inside the pipe, so that a critical rotation value can also be achieved at the burner output with this configuration.

FIG. 2 shows the same premix burner of FIG. 1, but from a different perspective and in a simplified view. FIG. 2 is essentially intended to clearly show the configuration of this premix burner. In particular, FIG. 2 is a relatively good depiction of the offset of the two partial bodies 1, 2 relative to each other in relation to the main center axis 26 of the premix burner, which corresponds to the main center axis of the central fuel nozzle 11. This offset actually determines the size of the flow-through openings of the tangential air inlet channels 5, 6. The center axes 3, 4 here extend parallel to each other.

FIG. 3 is a schematic view of an axial cross-section of the premix burner and shows the design of the tangential air inlet channels which cause a reinforcement of the flame front against an unhindered flash-back of the same into the premix burner. The design is such as to provide equally sized flow-through openings of the tangential air inlet channels only in one end zone 5*a*, 6*a* of the rotation formation in the premix burner, so that the flame front then is not supplied by an asymmetrical flow. Upstream, the tangential air inlet channels differ in some places in terms of their flow-through opening in such a way that a reduction of the flow-through opening in a section 6*b*, 6*d* of one air inlet channel causes a corresponding enlargement for the same section 5*b*, 5*d* in the opposite air inlet channel, and vice versa. FIG. 3 shows that upstream this alternating change (5*b* to 5*c* to 5*d* on one side, and 6*b* to 6*c* to 6*d* on the other side) of the flow-through openings is intermittent. This means that within the section of the premix burner, a complete yet mutually stabilizing disorder on the burner axis is present, preventing the flame front from being able to flash back unhindered. The symmetry requirements of the backflow zone are accounted for in the end zone 5*a*, 6*a* of the premix burner. The flow-through openings which differ in sections can be statically predisposed or, as will be explained for FIGS. 4–6, can be set dynamically according to the respective requirements. A continuously regulated change in the size of the flow-through opening, e.g. based on a measured value via the flame stability, is also possible. The number of different sections 5*b–d*, 6*b–d* with regard to the flow-through openings will be determined on a case by case basis.

Figure 4:
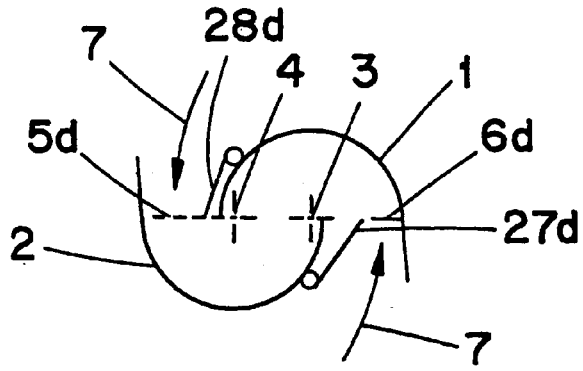
FIG. 4 is a cross-sectional view of the burner along the line IV—IV in FIG. 3.
Figure 5:
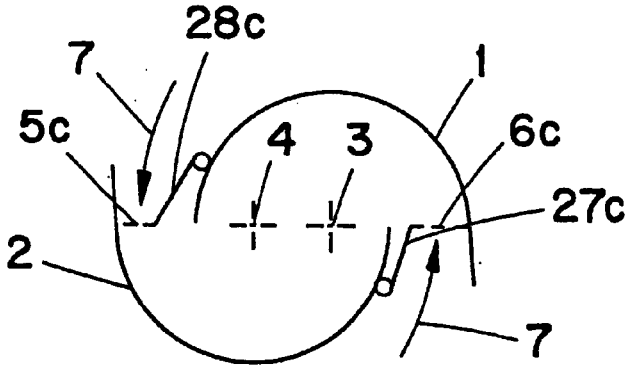
FIG. 5 is a cross-sectional view of the burner along the line V—V in FIG. 3.
Figure 6:
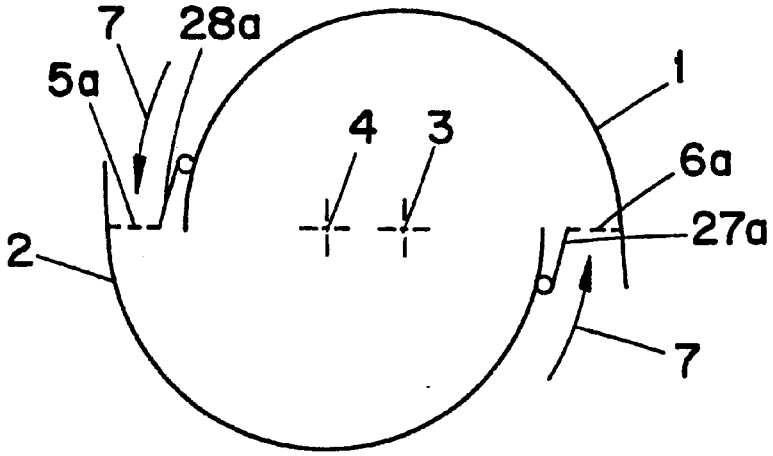
FIG. 6 is a cross-sectional view of the burner along the line VI—VI in FIG. 3.

FIGS. 4–6 are individual, schematic sections through the premix burner, whose planes are shown in FIG. 3. FIG. 4 shows the initial section of the premix burner, FIG. 5 shows an intermediary section, while FIG. 6 shows the final zone of the premix burner. In the last mentioned section 5*a*, 6*a*, the flow-through openings of both sections of the tangential air inlet channels are of equal size.

In FIGS. 4 and 5, the tangential air inlet channels are of different sizes in relation to each other (5*b* to 6*b*, 5*c* to 6*c*, 5*d* to 6*d*). The size of the flow-through opening is realized here with adjustable guide plates 27*a–d* and 28*a–d*, which can be adjusted accordingly for various sections and adjusted autonomously to each other. Naturally, these guide plates are constructed so as to conform with the flow.

While this invention has been illustrated and described in accordance with a preferred embodiment, it is recognized that variations and changes may be made without avoiding the scope of this invention, as set forth in the claims.

What is claimed is:

1. A premix burner for operating a combustion chamber with a liquid and/or gaseous fuel, of the type wherein combustion air flows through tangential air inlet channels into a premixing section formed by an axial extension of the premix burner, wherein the premix burner is provided with means for inducing a critical rotation value at an outlet end of the premix burner, whereby at least one pair of tangential air inlet channels are arranged at a downstream end air inlet zone of the premix burner for a symmetrical rotational flow, and pairs of tangential inlet channels are arranged upstream from the downstream end air inlet zone, the pairs of air inlet channels being arranged at a same axial position of the burner and each respective pair having different width flow-through openings relative to each other and on diametrically opposite sides of the burner for creating an asymmetrical rotational flow.

2. The premix burner as claimed in claim 1, wherein the premix burner has at least two hollow, conical partial bodies that are stacked inside each other in a flow direction, center axes of these partial bodies being offset to each other, whereby adjacent walls of the partial bodies form tangential air inlet channels for combustion air, and the premix burner is operated with at least one fuel nozzle.

3. The premix burner as claimed in claim 2, wherein the burner has an axis and includes a fuel nozzle which is arranged at an upstream end and on the burner axis.

4. The premix burner as claimed in claim 2, wherein the burner includes a plurality of fuel nozzles that are spaced apart along the tangential air inlet channels in the axial extension of the premix burner.

5. The premix burner as claimed in claim 2, wherein the conical partial bodies form a conical cavity that increases constantly in the flow direction.

6. The premix burner as claimed in claim 2, wherein the partial bodies are stacked inside each other in a spiral-shape.

7. The premix burner as claimed in claim 1, wherein a first of a pair of tangential air inlet channels upstream from the downstream end air inlet zone has a larger flow-through opening than that of the at least one pair of tangential inlet channels at the downstream end air inlet zone and a second pair of tangential air inlet channel has a flow-through opening that is smaller than at least one pair of tangential inlet channels at the downstream end air inlet zone.

8. A premix burner comprising a pair of partial conical bodies stacked inside each other to form a pair of flow through channels on diametrically opposite sides of the burner, the channels being arranged to induce air flow in complementary tangential directions, the channels each having a series of phases air inlet zones spaced longitudinally along the channels, a width of the channel at a downstream end air inlet zone of the burner being substantially the same on diametrically opposite sides of the burner, and the air inlet zones at locations progressively spaced from the downstream end air inlet zone alternate between a greater width and a lesser width in a radial direction than the width of the downstream end air inlet zone, each channel air inlet zone that has a lesser width on one side of the burner has a corresponding air inlet zone on the opposite side of the burner with a greater width for creating rotational asymmetry upstream from the downstream end air inlet zone.

* * * * *